US006615471B2

(12) United States Patent
Cape et al.

(10) Patent No.: US 6,615,471 B2
(45) Date of Patent: Sep. 9, 2003

(54) METHOD OF LOCATING THE BLADE HOLDERS IN A FIN FOLDING MACHINE

(75) Inventors: Gary D. Cape, Peoria, IL (US); Douglas R. Ervin, Metamora, IL (US)

(73) Assignee: Solar Turbines Inc, San Diego, CA (US)

( * ) Notice: Subject to any disclaimer, the term of this patent is extended or adjusted under 35 U.S.C. 154(b) by 0 days.

(21) Appl. No.: 09/781,831

(22) Filed: Feb. 12, 2001

(65) Prior Publication Data

US 2002/0108225 A1 Aug. 15, 2002

(51) Int. Cl.[7] ..... B23Q 17/00; B21D 53/02

(52) U.S. Cl. ..... 29/407.1; 29/407.01; 29/407.03; 29/407.04; 29/407.05; 29/890.03

(58) Field of Search ..... 29/407.1, 407.05, 29/709, 890.03, 407.09, 407.04, 407.01; 72/187, 9.2, 8.6, 186, 196; 226/39; 242/419.4

(56) References Cited

U.S. PATENT DOCUMENTS 4,625,378 A 12/1986 Tanno et al.
4,688,631 A 8/1987 Peze et al.
5,092,038 A 3/1992 Geppelt et al.
5,168,923 A 12/1992 Sacks
5,494,100 A 2/1996 Peze
5,630,269 A 5/1997 Wasserbaech et al.
5,669,441 A 9/1997 Spencer
5,685,075 A 11/1997 Kato
5,758,535 A * 6/1998 Pardi et al. ..... 72/187

* cited by examiner

*Primary Examiner*—John C. Hong
(74) *Attorney, Agent, or Firm*—Larry G Cain

(57) ABSTRACT

A fin folding machine has a base, a pair of vertical side support members extending from the base. A top support member is spaced from the base and is attached to the pair of vertical side support members. The base, pair of vertical side support members, and the top support member defining an opening therebetween. A plurality of tools are movably positioned within the opening. A bar has a plurality of sensors positioned therein abut a plurality of sides. The sensors send corresponding signals to a controller which monitors the position of the plurality of tools relative to a preestablished position. And, the plurality of tools are moved to the preestablished position. The sensors monitor the preestablished position of a depth and taper of a plurality of deep serpentine upper grooves and a plurality of deep serpentine lower grooves.

12 Claims, 7 Drawing Sheets

12
34
70
36
70
40
16
64
60
20
66
62
70
70

METHOD OF LOCATING THE BLADE HOLDERS IN A FIN FOLDING MACHINE

TECHNICAL FIELD

The present invention relates to a method of making a recuperator, and more particularly to a machine having a plurality of blades in which a sheet is folded thereabout to form a plurality of fins on such sheet.

BACKGROUND ART

A recuperator is a special type of heat exchanger and is used with engines, especially gas turbines, to increase the efficiency of such engines. Many of these recuperators are of a primary surface construction. In a primary surface recuperator, a plurality of sheets are stacked in a spaced apart configuration. The spacing therebetween forms a plurality of donor passages and a plurality of recipient passages. In many operations, a hot exhaust gas is passed through the donor passages and an atmospheric temperature intake air is passed through the recipient passages. Heat from the hot exhaust is conducted through the sheet and absorbed by the cooler intake air. Thus, thermal energy from the exhaust gas is extracted and conducted to the intake air increasing the efficiency of the engine.

In many applications the primary surface sheet used in forming the recuperator is very thin, flimsy and difficult to maintain a uniform cross sectional area of the passages between sheets. To enhance the rigidity of the thin sheets, the sheets are formed into an accordion type configuration forming peaks or crests and valleys forming a plurality of upwardly and downwardly opening, transversely extending, relatively deep grooves being relatively closely spaced and having substantially vertical sidewalls or fins. In forming a recuperator using such sheets, the peeks of alternate sheets are aligned and the valleys of alternate sheets are aligned to form the donor passages and the recipient passages. The height and width of the peeks and valleys must be maintained very accurately to insure the effectiveness of the recuperators. For example, if the cross sectional area of either the donor passage or the recipient passage is too small excess resistance will occur and the fluid will resist flowing through the respective passage. On the other hand, if the cross sectional area of either the donor passage or the recipient passage is too large the fluid will pass through the passage and fail to donate or receive the heat from the fluid. Additionally, many of the sheets are formed with a serpentined configuration to enhance a controlled turbulent which increases heat conductivity and resulting efficiency.

U.S. Pat. No. 5,674,803 issued on Dec. 9, 1997 to Douglas R. Ervin, Clifford G. Knepper and Thomas K. Quinn discloses such a fin folding machine. In forming the primary surface sheet or plate with the serpentined configuration, the fin folding machine is used. The fin folding machine has a pair of upper and lower clamping tools and a pair of upper and lower forming tools. The clamping and forming tools have an elongated plate to which is attached a tool holder having a tool therein. A plurality of cam devices actuate the tool holder and in turn the clamping and forming tools to engage and form a single convolution of the sheet. As the crest and valley is formed the sheet is indexed and the motion of the clamping and forming tools are repeated until the folded sheet is formed having a plurality of crests and valleys. As the crests and the valleys are formed the interface of the blades and the sheet causes the tool to wear and must be replaced. Additionally, as the cams wear the accuracy of the machine diminishes to a level wherein the folded sheet is out of tolerance. In order to insure the consistency, accuracy and uniformity of the sheet and the resulting efficiency of the recuperator the fin folding machine will need to be rebuild or replaced. And, as the need for additional machines arise the accuracy between fin folding machines must be maintained.

The present invention is directed to overcoming one or more of the problems as set forth above.

DISCLOSURE OF THE INVENTION

In one aspect of the invention a method of setting a plurality of tools in a fin folding machine to a preestablished position is disclosed. The fin folding machine has a base, a pair of vertical side support members extending from the base and a top support member spaced from the base and attached to the pair of vertical side support members. The base, pair of vertical side support members, and the top support member define an opening therebetween. The fin folding machine has the plurality of tools movably positioned within the opening and forms a corrugated sheet of material having a plurality of deep serpentine upper grooves and a plurality of deep serpentine lower grooves. The method of the setting the plurality of tools in the fin folding machine comprising the following steps: positioning a bar within the opening; attaching the bar to one of the plurality of tools; monitoring a position of the bar with respect to the one of the plurality of tools; monitoring a position of the bar with respect of each of the other ones of the plurality of tools; and adjusting the monitored position of each of the other ones of the plurality of tools to a preestablished relationship to the one of the plurality of tools having the bar attached thereto.

In another aspect of the invention a bar positions a plurality of tools in a fin folding machine. The bar is comprised of a plurality of sides having a preestablished configuration and a plurality of sensor bores are positioned in respective ones of the plurality of sides.

And, in another aspect of the invention a fin folding machine has a base, a pair of vertical side support members extending from the base and a top support member is spaced from the base and attached to the pair of vertical side support members. The base, pair of vertical side support members, and the top support member defines an opening therebetween. The fin folding machine has a plurality of tools movably positioned within the opening and a bar has a plurality of sensors positioned therein. The bar positions a plurality of the plurality of tools into a preestablished position one relative to another of the plurality of tools

BRIEF DESCRIPTION OF THE DRAWINGS

FIG. 9 has illustrations A,B,C,D, and E which are detailed views of a portion of a set up gage which is a bar;

BEST MODE FOR CARRYING OUT THE INVENTION

Figure 1:
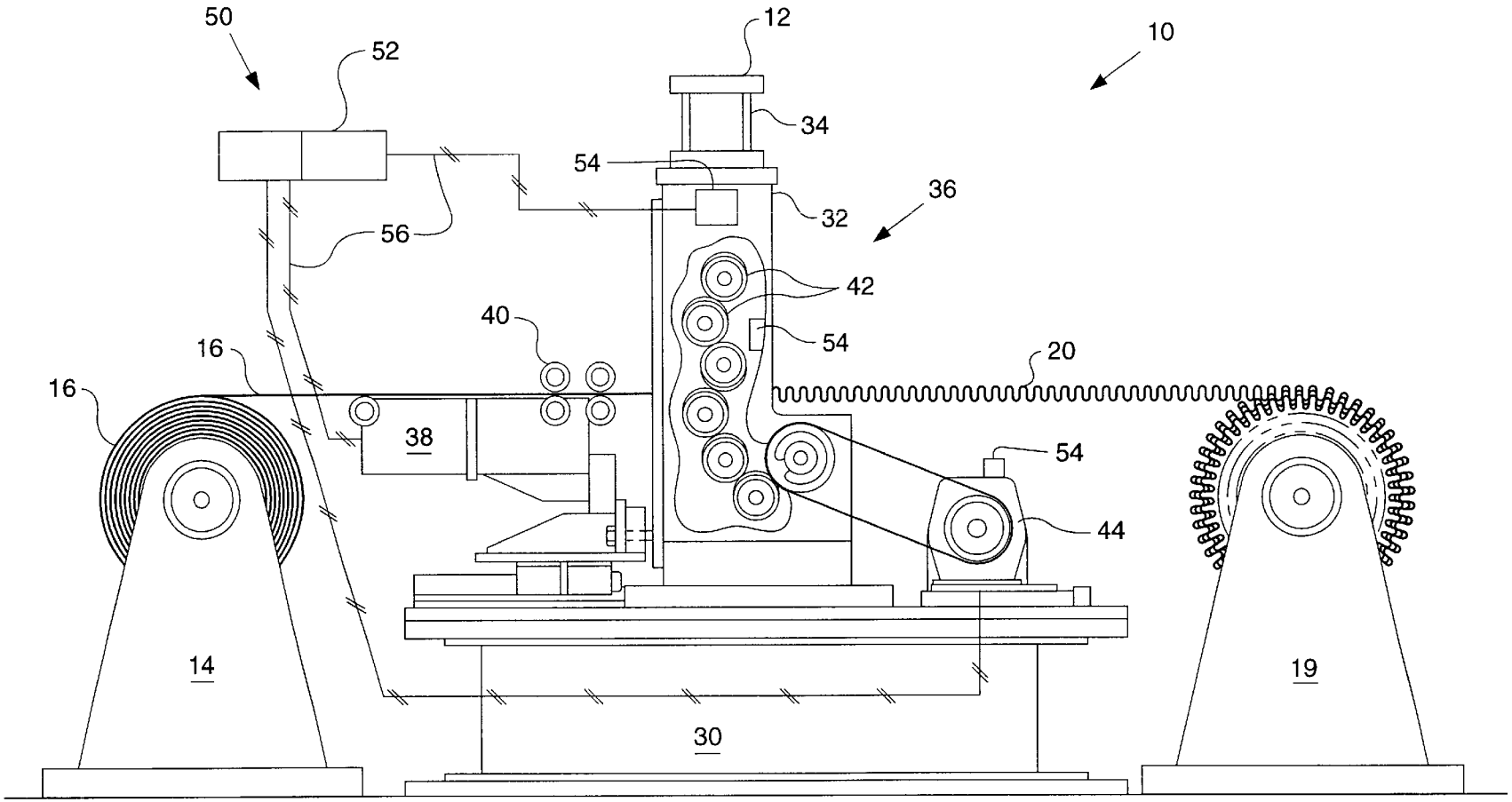
FIG. 1 is a view of a fin folding line having a fin folding machine therein.
Figure 2:
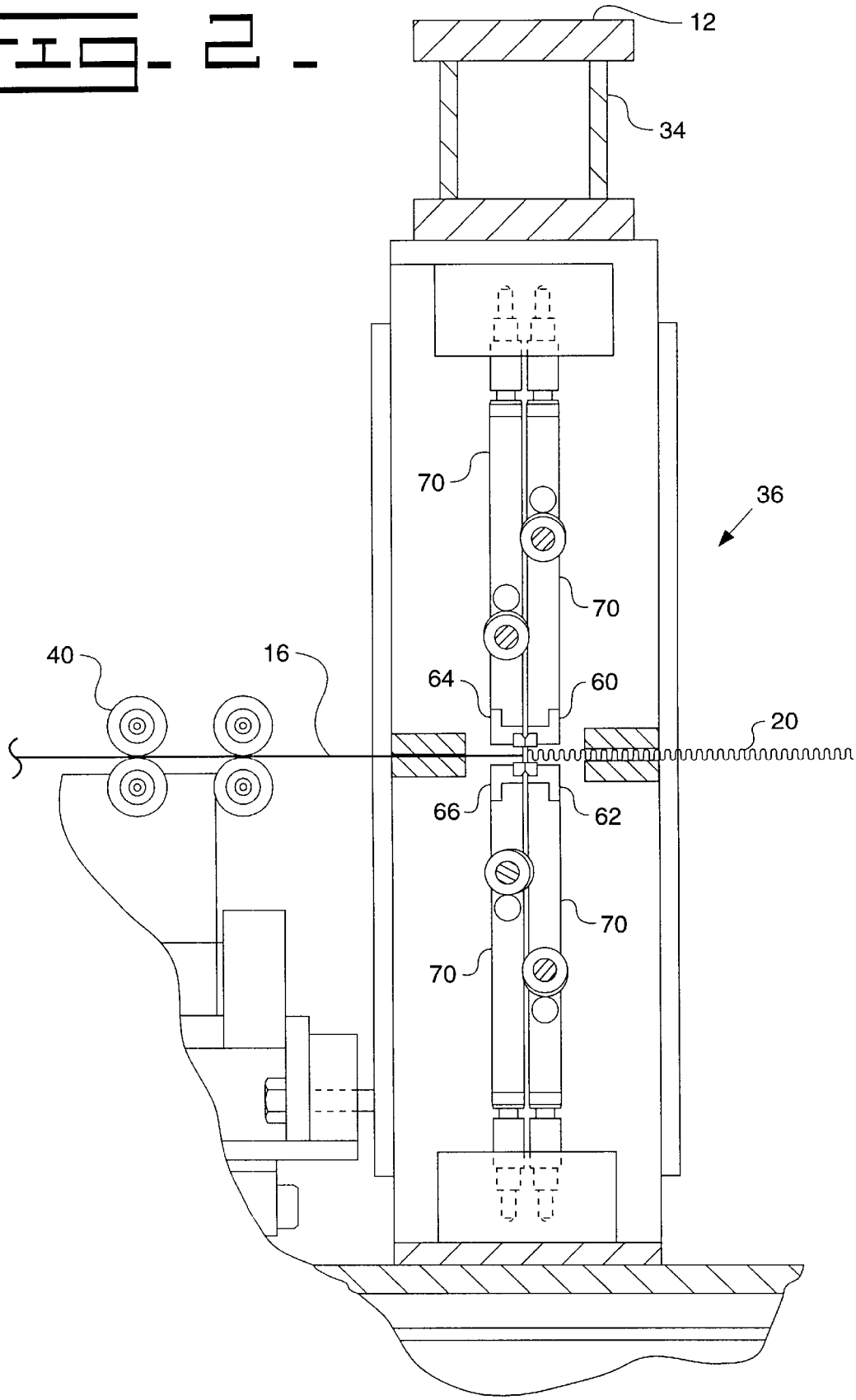
FIG. 2 is an enlarged view of a portion of the fin folding machine showing a clamping member and a forming member.
Figure 4:
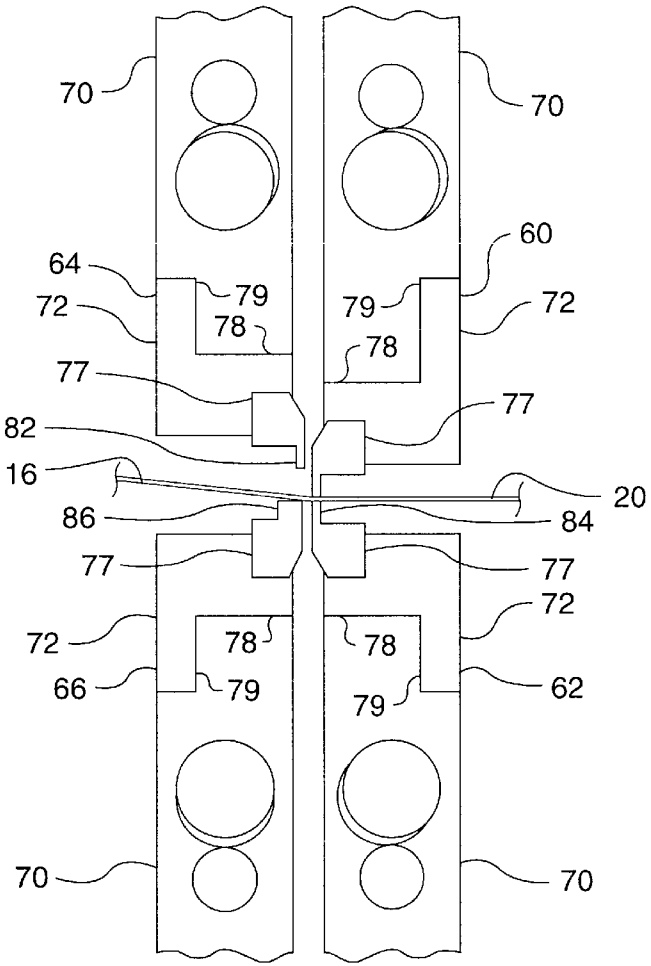
FIG. 4 is an enlarged detailed view of the clamping and forming members shown with an upper clamping tool and a lower clamping tool in a sheet material stop position and illustrates one of a variety of sequential position during operation of the fin folding machine.
Figure 3:
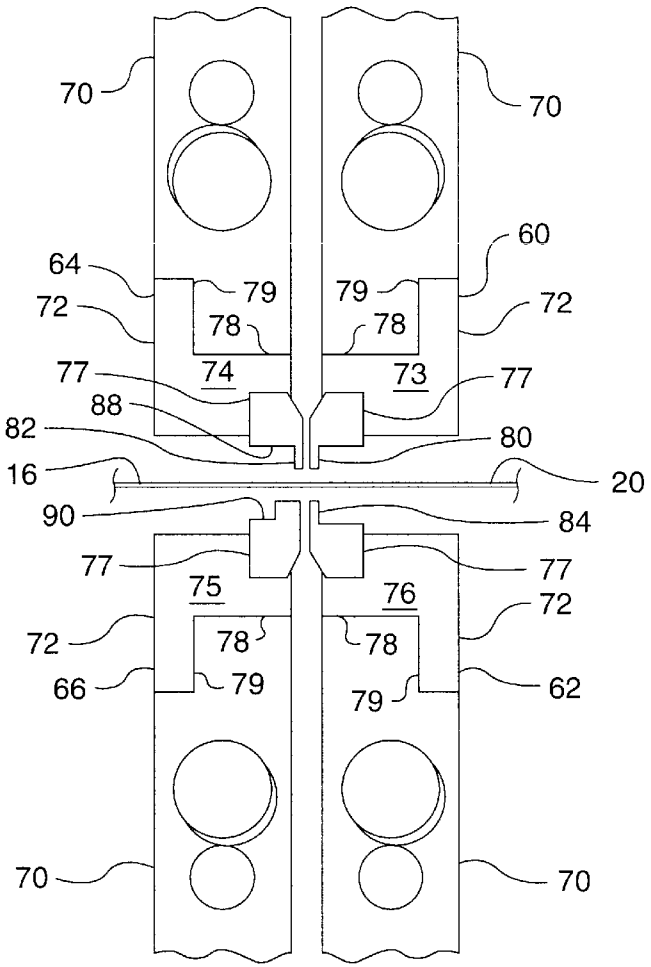
FIG. 3 is an enlarged detailed view of the clamping and forming members shown in a clearance position and illustrates one of a variety of sequential position during operation of the fin folding machine.
Figure 7:
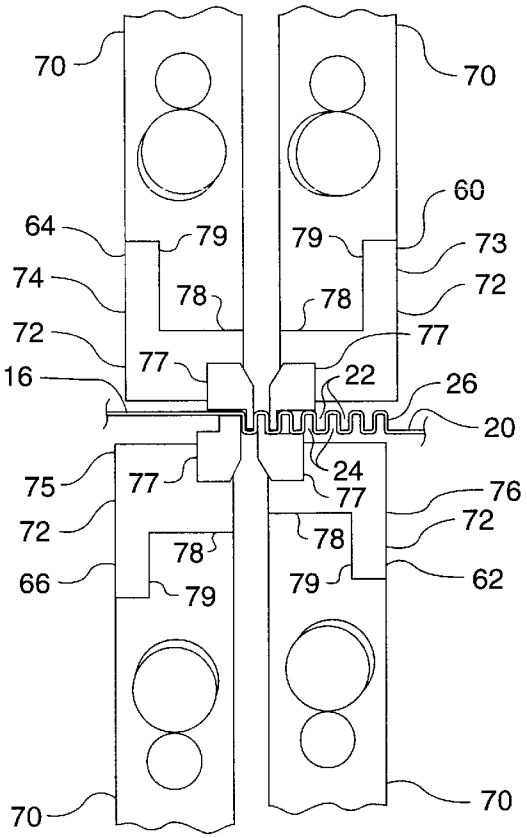
FIG. 7 is an enlarged detailed view of the clamping and forming members shown with a lower forming tool having formed a flattened area on sheet material and illustrates one of a variety of sequential position during operation of the fin folding machine.
Figure 6:
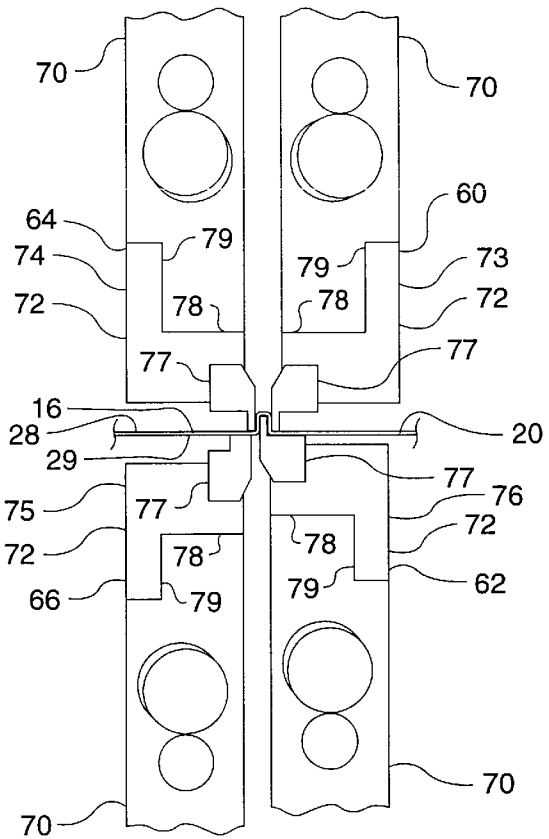
FIG. 6 is an enlarged detailed view of the clamping and forming members shown with an upper forming tool having formed a second fin and illustrates one of a variety of sequential position during operation of the fin folding machine.
Figure 5:
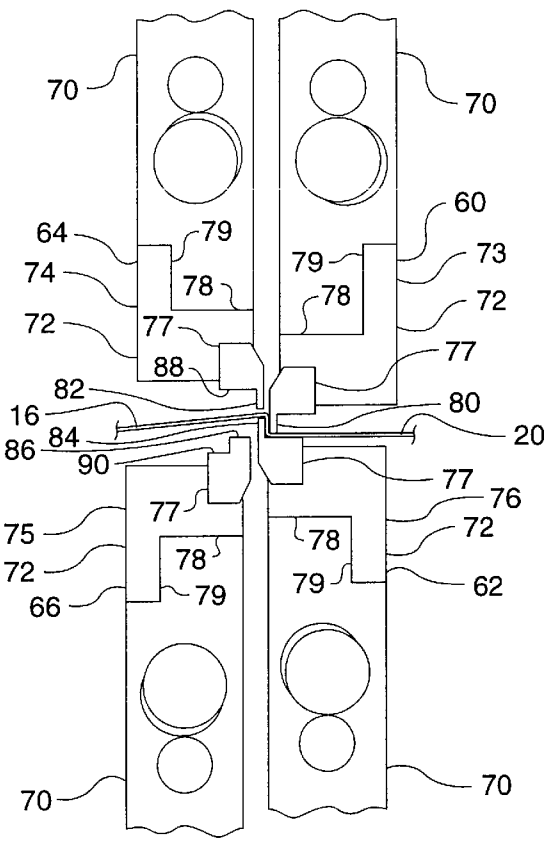
FIG. 5 is an enlarged detailed view of the clamping and forming members shown the upper clamping tool and the lower clamping tool having formed a fin and illustrates one of a variety of sequential position during operation of the fin folding machine.
Figure 11:
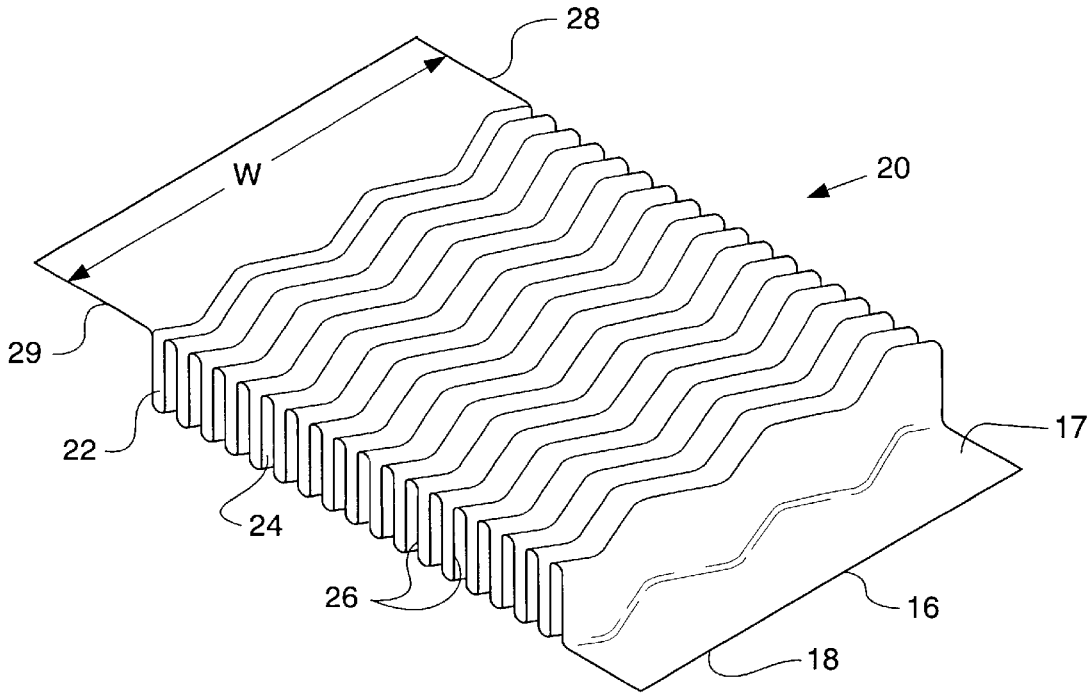
FIG. 11 is a pictorial view of a sheet having the fins formed on the sheet.

FIG. 1 illustrates a fin folding line or system 10 having a fin folding machine 12. Positioned at one end of the line 10 is a delivery reel stand 14 having a roll of sheet material 16 positioned therein. The roll of sheet material has a first surface 17 and a second surface 18. And, positioned at the other end of the line 10 is a take-up reel stand 19 having the sheet material being corrugated 20 after being process by the fin folding machine 12 positioned therein. The sheet material 16 after being corrugated 20, as best shown in FIG. 11, defines a plurality of deep serpentined upper grooves 22 and a plurality of deep serpentined lower grooves 24 which form a plurality of fins 26 having a preestablished spacing therebetween defining a given number of fins per length of folded sheet (f\l). The sheet material 16 also has a preestablished width (w) defined between a first side 28 and a second side 29.

The fin folding machine 12 has a base member 30 to which are attached a pair of vertical side support members 32. A top support member 34 extends between the pair of vertical side support members 32. The sheet material 16 passes through an opening 36 positioned between the base member 30, the vertical side support members 32 and the top support member 34. Positioned between the delivery reel stand 14 and the fin folding machine 12 and attached to the fin folding machine 12 is a material feeder 38. Positioned between the material feeder 38 and the fin folding machine 12 is an inlet guide 40. A plurality of cam members 42 are operatively positioned in each of the pair of vertical side support members 32 and are operatively rotatable by a drive motor 44 in a conventional manner.

A control system 50 is in communication with the fin folding line 10. The control system 50 has a controller 52 being in communication with a plurality of sensors 54, one of which is positioned on at least one of the pair of vertical side support members 32. A plurality of communication wires 56 extend between the respective one of the plurality of sensors 54 and the controller 52. One of the plurality of communication wires 56 communicates with the material feeder 38. And another one of the plurality of communication wires 56 communicates with the drive motor 44. A plurality of signals 58, not shown, are transmitted from the respective one of the plurality of sensors 54 to the controller 52 to indicate the relative positions of the plurality of cam members 42. And, a plurality of signals 58 are transmitted from the material feeder 38 to the controller 52 and from the controller 52 to the motor 44.

As best shown in FIGS. 2–7, the fin folding machine 12 has a pair of upper clamping tools 60 and a pair of lower clamping tools 62 which are positioned on opposite sides of the sheet material 16. A pair of upper forming tools 64 and a pair of lower forming tools 66 are a part of the fin folding machine 12 and are positioned on opposite sides of the sheet material 16. Each of the clamping and forming tools 60, 62, 64, 66, have an elongated plate 70 attached thereto at an end. The elongated plate 70 communicates with the plurality of cam members 42 in a conventional manner. A tool holder 72 is attached to the other end of a respective plate 70. Each of the tool holders 72, being four in number in this application, a first tool holder 73, a second tool holder 74, a third tool holder 75 and a fourth tool holder 76 has a tool 77 attached to the respective one of the tool holders 72. Each of the first tool holder 73, and the second tool holder 74, the third tool holder 75 and the fourth tool holder 76 has a bottom or first machined surface 78 thereon and a back or second machined surface 79 thereon. The tool 77 of the upper clamping tool 60 has a downwardly extending serpentined knife blade portion 80. The knife blade portion 80 is configured to be positioned into the last to be formed upwardly opening groove 22. The tool 77 of the upper forming tool 64 has a downwardly extending serpentine knife blade portion 82. The knife blade portion 82 is configured to be positioned against the last fin 26 to be formed of the last formed groove 24 and is in a closely spaced offset and mating relationship to the blade portion 80 of the upper clamping tool 60. The tool 77 of the lower forming tool 62 has a similar knife blade portion 84, while the tool 77 of the lower clamping tool 62 has a substantially flat distal end surface 86. An opposed end surface 88 formed on the upper tool 77 cooperates to flatten or de-wrinkle the sheet material 16 adjacent the last fir 26 with a flattened end surface 90 on the lower forming tool 77.

Figure 10:
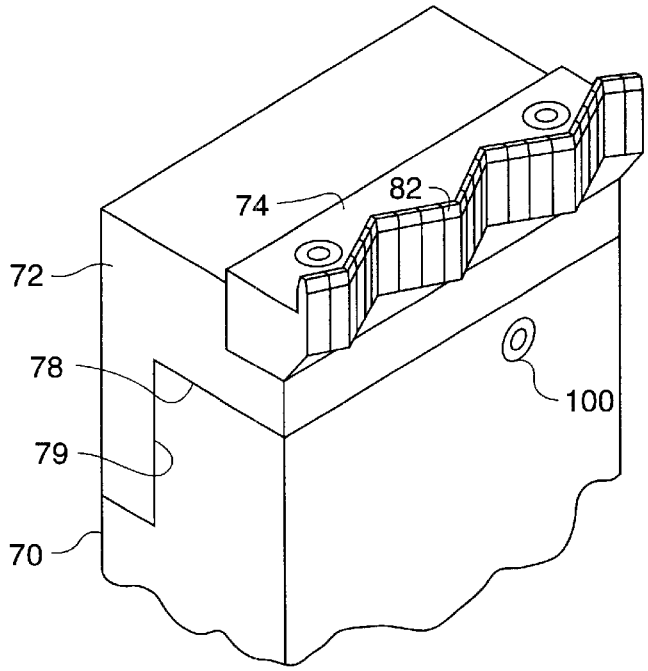
FIG. 10 is an enlarged view of one of the forming members.

In assembling a fin folding machine 10, the base member 30, the pair of vertical side support members 32 and the top support member are attached. The plurality of cam members 42 are positioned in the pair of vertical side supports 32 and the pair of upper clamping tools 60, the pair of lower clamping tools 62, the upper forming tools 64 and the pair of lower forming tools 66 are operatively attached to the plurality of cam members 42. Each of the clamping tools 60, 62 and the forming tools 64, 66 have the tool holder 72, first tool holder 73, second tool holder 74, third tool holder 75 and a fourth tool holder 76 respectively attached thereto in a removable fashion such as by a plurality of fasteners 100, as best shown in FIG. 10, which in this application are machine screws.

Figure 8:
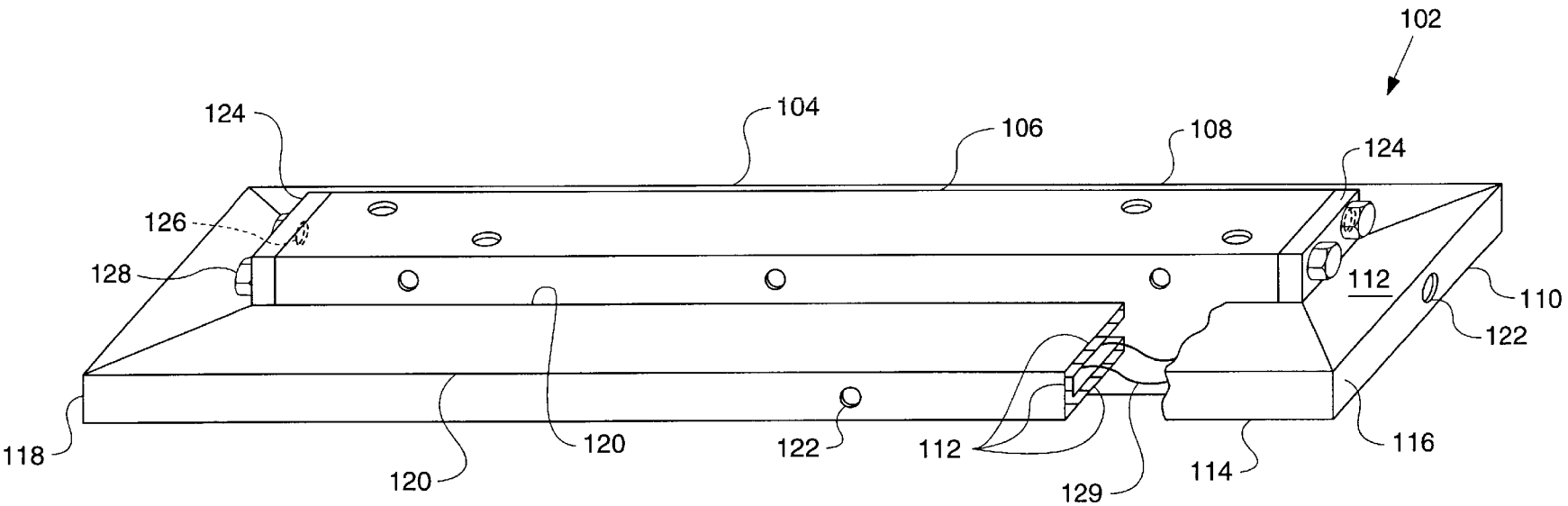
FIG. 8 is a pictorial view of a set up gage.
Figures 5A, 5B, 5C, 5D, 5E:
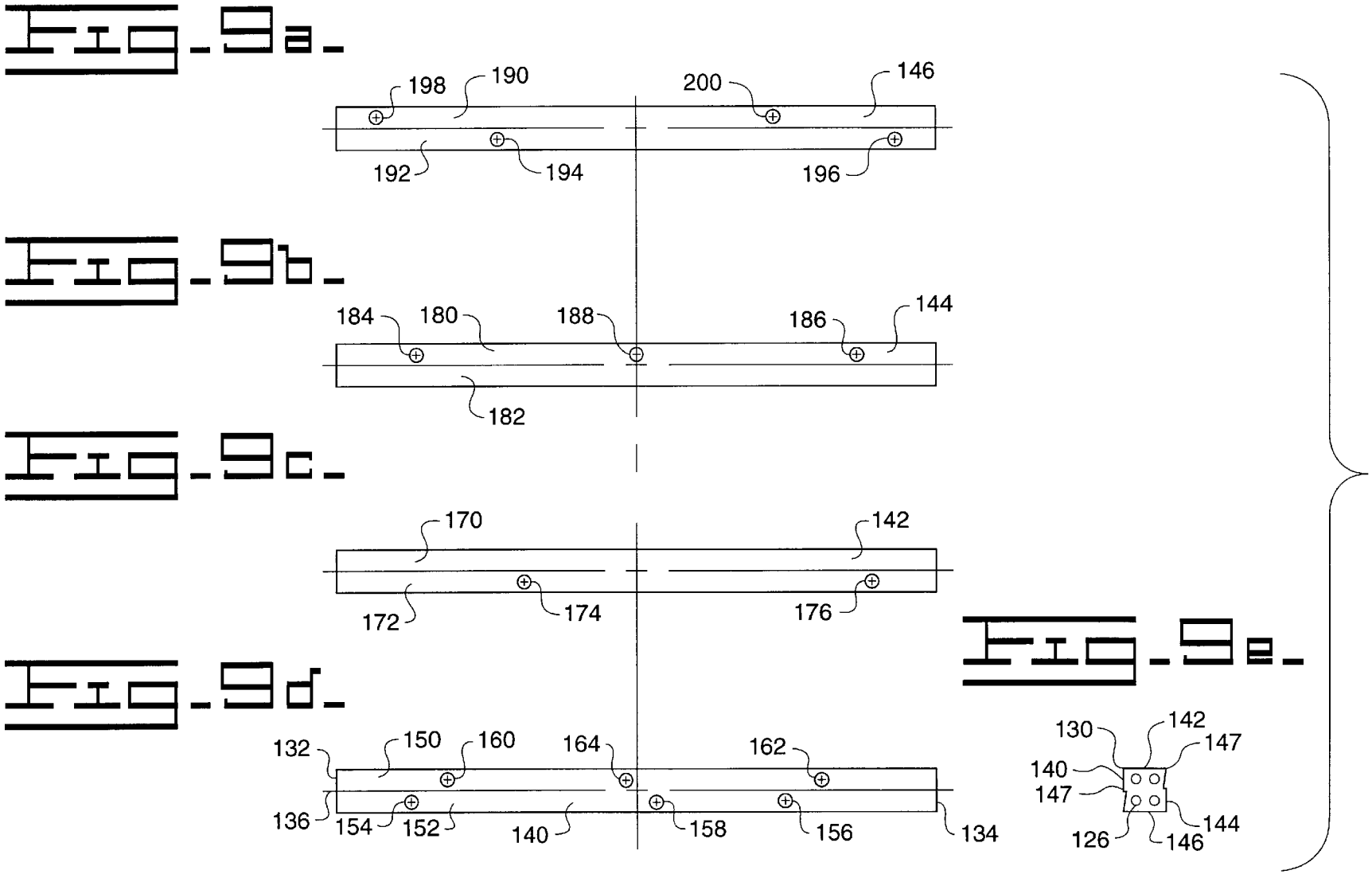

To insure the proper positioning of the knife blade portion 80, the knife blade portion 82, the knife blade portion 84 and the flat distal end surface 86, a setup gage or tool 102, as best shown in FIG. 8, is installed on the fin folding machine 12. The setup tool 102 has a outer shield 104 attached to a gage bar 106. In this application, the outer shield 104 is made by combining a first shield assembly 108 with a second shield assembly 110. Each of the first shield assembly 108 and the second shield assembly 110 is made of a plurality of sized aluminum plates 112 cut and fitted into a generally channel assembly 114 configuration. The channel assembly 114 has a first end 116 and a second end 118 extending between a pair of sides 120. A pair of holes 122 are positioned in the respective ones of the pair of sides 120 and each of the first end 116 and the second end 118. The holes 122 are spaced a preestablished distance from each of the pair of sides 120 and the first and second ends 116,118 respectively. A pair of wing portions 124 are attached near each of the first and second ends 116,118. And, each of the pair of wing portions 124 has a plurality of through holes 126 therein being space apart a predefined distance. A plurality of fasteners 128 removably attach the outer shield 104 to the gage bar 106. A plurality of wires 129 are positioned in the channel configuration 114 and interconnect the plurality of sensors 54 and the controller 52.

As best shown in the illustrations A,B,C,D, and E of FIG. 9, the gage bar 106 is made from a bar 130 being spaced between a first end 132 and a second end 134 a preestablished distance. The bar 130 has a substantially square cross sectional configuration defining a centerline, designated by the reference numeral 136, being spaced evenly from a first side 140, a second side 142, a third side 144 and a fourth side 146. In this application the square configuration is very closely machined to insure accuracy of the properly installing the first, second, third and fourth tool holders 73,74,75, 76. For example, the first side 140 is substantially perpendicular to the second side 142. The second side 142 is substantially perpendicular to the third side 144. The third side 144 is substantially perpendicular to the fourth side 146 and the fourth side 146 is substantially perpendicular to the first side 142. And, the first side 140 and the third side 144 is substantially parallel to each other. And, the second side 142 and the fourth sides is substantially parallel to each other. The first side 140 and the third side 144 each define a surface 147 of which has an offset configuration. Each of the first end 132 and the second end 134 has a plurality of, in this application four, threaded holes 148 defined therein. The four threaded holes 148 are positioned to correspond to the position of the holes 126 in each of the pair of wing portions 124 of the outer shield 104.

When looking perpendicular to the first side 140 of the bar 130, the centerline 136 divides the first side 140 into an upper half 150 and a lower half 152. Positioned in the lower half 152 of the first side 140 near the first end 132 of the bar 130 is a first sensor bore 154. A second sensor bore 156 is positioned in the lower half 152 of the first side 140 near the second end 134 of the bar 130. A third sensor bore 158 is positioned in the lower half 152 of the first side 140 of the bar 130 intermediate the first sensor bore 154 and the second sensor bore 156. The upper half 150 of the first side 140 of the bar 130 has a first sensor bore 160 positioned therein near the first end 132. In this application, the first sensor bore 160 of the upper half 150 of the first side 140 is axially spaced inwardly from the first sensor bore 154 in the lower half 152. A second sensor bore 162 is positioned in the upper half 150 of the first side 140 near the second end 134. In this application, the second sensor bore 162 of the upper half 150 of the first side 140 is axially spaced outwardly from the second sensor bore 156 in the lower half 152. A third sensor bore 164 is positioned in the upper half 150 of the first side 140 intermediate the first sensor bore 160 and the second sensor bore 162. In this application, the third sensor bore 164 of the upper half 152 of the first side 140 is axially spaced intermediate the third sensor bore 158 of the lower half 152 and the first sensor bore 160 of the upper half 150.

When looking perpendicular to the second side 142 of the bar 130, the centerline 136 divides the second side 142 into an upper half 170 and a lower half 172. Positioned in the lower half 172 of the second side 142 near the first end 132 of the bar 130 is a first sensor bore 174. In this application, the first sensor bore 174 is axially interposed the first sensor bore 160 in the upper half 150 of the first side 140 and the third sensor bore 164 in the upper half 150 of the first side 140. A second sensor bore 176 is positioned in the lower half 172 of the second side 142 near the second end 134 of the bar 130. In this application, the second sensor bore 176 is axially outward from the second sensor bore 162 in the upper half 150 of the first side 140 of the bar 130.

When looking perpendicular to the third side 144 of the bar 130, the centerline 136 divides the third side 144 into an upper half 180 and a lower half 182. Positioned in the upper half 180 of the third side 144 near the first end 132 of the bar 130 is a first sensor bore 184. In this application, the first sensor bore 184 is axially interposed the first sensor bore 160 in the upper half 150 of the first side 140 and the first sensor bore 154 in the lower half 152 of the first side 140. A second sensor bore 186 is positioned in the upper half 180 of the third side 144 near the second end 134 of the bar 130. In this application, the second sensor bore 186 is axially interposed the second sensor bore 176 in the lower half 172 of the second side 142 and the second sensor bore 162 in the upper half 150 of the first side 140. And, a third sensor bore 188 is positioned in the upper half 180 of the third side 144 and is interposed the first sensor bore 184 and the second sensor bore 186. In this application, the third sensor bore 188 is interposed the third sensor bore 164 in the upper half 150 of the first side 140 and the third sensor bore 158 in the lower half 152 of the first side 140.

When looking perpendicular to the fourth side 146 of the bar 130, the centerline 136 divides the fourth side 146 into an upper half 190 and a lower half 192. Positioned in the lower half 192 of the fourth side 146 near the first end 132 of the bar 130 is a first sensor bore 194. In this application, the first sensor bore 194 is axially interposed the first sensor bore 160 in the upper half 150 of the first side 140 and the first sensor bore 174 in the lower half 172 of the second side 142. A second sensor bore 196 is positioned in the lower half 192 of the fourth side 146 near the second end 134 of the bar 130. In this application, the second sensor bore 196 is axially outward of the second sensor bore 176 in the lower half 172 of the second side 142. A first sensor bore 198 is positioned in the upper half 190 of the fourth side 146 near the first end 132 of the bar 130. In this application, the first sensor bore 198 is axially outward from the first sensor bore 184 in the third side 144. A second sensor bore 200 is positioned in the upper half 190 of the fourth side 146 near the second end 134 of the bar 130. In this application, the second sensor bore 200 is axially interposed the second sensor bore 186 in the third side 144 and the third sensor bore 188 in the third side 144.

Each of the sensor bores 152,154,156,160,162, 164,174, 176,184,186,188,194,196,198,200 have a sensor 210 positioned therein. Each of the sensors 210 is operatively connected to a controller 212. The controller 212 being a computer 214 having the capability of comparing signals from the sensors 210 and comparing the respective signals one to another. The computer 214 has a viewer and/or is capable of providing a print out 216 for comparison.

INDUSTRIAL APPLICABILITY

In operation, the fin folding line or system 10 is actuated. The roll of sheet material 16 on the delivery reel stand 14 passes through the material feeder 38 into the inlet guide 40 and into the opening 36. Within the opening 36 the entire width (w) of the material 16 is folded between the first side 28 and the second side 29 by the fin folding machine 12.

After being folded, the material 16 results in the corrugated sheet 20 and is collected on the take-up reel stand 20.

For example, the action of the fin folding machine 12 is as follows. The action of the drive motor 44 causes the pair of upper clamping tools 60 and the pair of lower clamping tools 62 to clamp upon the material 16 and maintain the material 16 in a fixed or stationary position. The knife blade portion 80 of the upper clamping tool 60 of the tool 77 is forced downwardly toward the knife blade portion 84 of the tool 77 of the lower clamping tool 62. The knife blade portions 80 and 84 are space in an offseting relationship to effectively form a portion of the plurality of deep serpentined upper grooves 22 and a portion of the plurality of deep serpentined lower grooves 24 respectively. Additionally, the tool 77 of the upper forming tool 64 has the knife blade portion 82 forced downwardly toward the tool 77 of the lower clamping tool 62 knife blade portion 86. The opposed end surface 88 of the tool 77 in the upper forming tool 64 contacts the first surface 17 of the sheet 16. The flattened end surface 90 of the tool 77 in the lower forming tool 66 contacts the second surface 18 of the sheet 16. The opposed end surface 88 and the flattened end surface 90 cooperate to flatten or de-wrinkle the sheet material 16 adjacent the last fin 26. Thus, the cycle is repeated and the sheet material is formed into the finished corrugated sheet 20. The finished corrugated sheet 20 is wound around the take-up reel for further use in manufacturing a recuperator, not shown. The end product has a preestablished spacing or number of fines per length of folded sheet (f\l).

The control system 50 communicates with the drive motor 44 to activate the cam action for the fin folding machine 12. The plurality of sensors 54 send signals 58 to the controller 52 and the controller 52 stores and compares these signals against a standard to determine the accuracy of the finished product. For example, the height of the plurality of deep serpentined upper grooves 22 and the plurality of deep serpentined lower grooves 24 are monitored. Additionally, the number of fins per length of folded sheet (f/l) is monitored.

If the monitoring determines that the accuracy of the corrugated sheet 20 is not to specification, the reason for the inaccuracy must be determined and repairs must be made. Past experience has shown that some inaccuracies can be overcome by changing a worn tool 77. But, other inaccuracies require major overhauling of the fin folding machine 12. It is during these overhauling and new machine production that the setup gage or tool 102 comes into operation. For example, replacement cam members 42 and other warn components such as bearings and bushings are replaced or if a new fin folding machine 12 is being made or new components are assembled. In this application, each of the tool holders 73, 74, 75, 76 are attached to a respective one of the elongated plates 70. The setup gage 102 is positioned in tool holder 76. Witch each of the elongated plates 70 extended the bar 130 is positioned in place of the tools 77 of the upper clamping tool 60, the upper forming tool 64, lower clamping tool 62. The fin folding machine 12 is operated to move the plurality of cams 42 into a position so that the first machine surface 78 and the second machined surface 79 of each of the upper clamping tool 60, the upper forming tool 64 and the lower forming tool 66 can be monitored or measured with reference to the relative position of the respective one of the plurality of sensors 54 within the bar 130. The signal 58 from the respective one of the plurality of sensors 54 is monitored and recorded by the controller 52. Thus, the relative position of the upper clamping tool 60, the lower clamping tool 62, the upper forming tool 64 and the lower forming tool 66 can be defined with reference to the setup gage 102. And, the relative position of the upper clamping tool 60, the lower clamping tool 62, the upper forming tool 64 and the lower forming tool 66 can be corrected by shimming between the interface of the respective first machined surface 78 and the second machined surface 79 of the elongated relate 70. With the plurality of sensors 54 being positioned in each of the four sides 140, 142, 144, 146 of the bar 130, it is capable to monitor the resulting height of the fin 20, the depth of the upper groove 22, the depth of the lower groove 24, the spacing of the donor passage and the recipient passage and the angularity of the spacing to insure the proper number of fins per length (f/l) of folded sheet.

For example, with the gage tool 102 positioned in place of the tool 77 in the lower clamping tool 62, the pair of sensors 54 positioned in the sensor bore 198 and the sensor bore 200 on the fourth side 146 are used to define the position of the upper clamping tool 62 relative to the first machined surface 78 of the elongated plate 70 to which the upper clamping tool 62 is attached. The pair of sensors 54 positioned in the sensor bore 194 and the sensor bore 196 on the fourth side 146 are used to define the position of the upper forming tool 64 relative to the first machine surface 78 of the elongated plate 70 to which the upper forming tool 64 is attached. And, the pair of sensors 54 positioned in the sensor bore 174 and the sensor bore 176 of the second side 142 are used to define the position of the lower forming tool 66 relative to the first machine surface 78 of the elongated plate 70 to which the lower forming tool 66 is attached.

The three sensors 54 positioned in the sensor bore 184, sensor bore 188 and the sensor bore 186 on the third side 144 are used to define the position of the upper clamping tool 60 relative to the second machined surface 79 of the elongated plate 70 to which the upper clamping tool 60 is attached.

The three sensors 54 positioned in the sensor bore 160, sensor bore 164 and the sensor bore 162 on the first side 140 are used to define the position of the upper forming tool 64 relative to the second machined surface 79 of the elongated plate 70 to which the upper forming tool 64 is attached.

The three sensors 54 positioned in the sensor bore 154, sensor bore 158 and the sensor bore 156 on the first side 140 are used to define the position of the lower forming tool 66 relative to the second machined surface 79 of the elongated plate 70 to which the lower forming tool 66 is attached.

In view of the forgoing, when a fin folding machine 12 is reworked, repaired or remanufactured, the consistency or repetitiveness of the finished product, the primary surface corrugated sheet material, can be insured.

Other aspects, objects and advantages of this invention can be obtained from a study of the drawings, the disclosure and the appended claims.

What is claimed is:

1. A method of setting a plurality of tools in a fin folding machine to a reestablished position, said fin folding machine having a base, a pair of vertical side support members extending from the base and a top support member spaced from said base and being attached to said pair of vertical side support members, said base, said pair of vertical side support members, and said top support member defining an opening therebetween, said fin folding machine having said plurality of tool movably positioned within said opening and forming a corrugated sheet of material having a plurality of deep serpentined upper grooves and a plurality of deep serpentine lower grooves; said method of the setting the plurality of tools in said fin folding machine comprising the following steps:

positioning a bat within said opening, said bar having a plurality of sides and each of said plurality of sides having a plurality of sensors therein;

attaching said bar to one of said plurality of tools;

monitoring a position of said bar with respect to said one of said plurality of tools;

monitoring a position of said bar with respect of at least another ones of a position of said plurality of tools; and adjusting said monitored position of each of said another ones of said plurality of tools to a preestablished relationship to said one of said plurality of tools having said bar attached thereto.

2. The method of setting a plurality of tools in a fin folding machine to a preestablished position of claim 1 wherein said plurality of sensors sending a signal to a controller.

3. The method of setting a plurality of tools in a fin folding machine to a preestablished position of claim 2 where said controller including a computer.

4. The method of setting a plurality of tools in a fin folding machine to a preestablished position of claim 1 wherein said step of monitoring said position of said bar with respect of at least another one of said plurality of tools includes monitoring one of said another one of said plurality of tools at a time.

5. The method of setting a plurality of tools in a fin folding machine to a preestablished position of claim 4 wherein said step of adjusting said monitored position of each of said other ones of said plurality of tools to a preestablished relationship includes adjusting one of said other ones of said plurality of tools at a time.

6. The method of setting a plurality of tools in a fin folding machine to a preestablished position of claim 1 wherein said bar defines a preestablished position for monitoring a depth of said plurality of deep serpentine upper grooves in said corrugated sheet of material.

7. The method of setting a plurality of tools in a fin folding machine to a preestablished position of claim 1 wherein said bar defines a preestablished position for monitoring a depth of said plurality of deep serpentine lower grooves in said corrugated sheet of material.

8. The method of setting a plurality of tools in a fin folding machine to a preestablished position of claim 1 wherein said bar defines a preestablished position for monitoring taper of each of said plurality of tools forming said upper grooves and said lower grooves in said corrugated sheet of material.

9. The method of setting a plurality of tools in a fin folding machine to a preestablished position of claim 1 wherein said fin folding machine being a new fin folding machine.

10. The method of setting a plurality of tools in a fin folding machine to a preestablished position of claim 1 wherein said fin folding machine being a rebuild fin folding machine.

11. The method of setting a plurality of tools in a fin folding machine to a preestablished position of claim 1 wherein said step of monitoring a position of said bar with respect of at least another one of said plurality of tools includes a pair of sensors being positioned in a side of said bar, and said pair of sensors monitoring a depth of said plurality of deep serpentine upper grooves and said plurality of deep serpentine lower grooves.

12. The method of setting a plurality of tools in a fin folding machine to a preestablished position of claim 1 wherein said step of monitoring a position of said bar with respect of at least another one of said plurality of tools includes at least three sensors being positioned in a said of said bar, and said at least three sensors monitoring a tape of said plurality of deep serpentine upper grooves and said plurality of deep serpentine lower grooves.

* * * * *